US006180193B1

(12) United States Patent
Bostedt

(10) Patent No.: US 6,180,193 B1
(45) Date of Patent: Jan. 30, 2001

(54) DECORATIVE LAWN ORNAMENT

(76) Inventor: Dawn Marie Bostedt, 2180 Riverside Dr., Green Bay, WI (US) 54313

( * ) Notice: Under 35 U.S.C. 154(b), the term of this patent shall be extended for 0 days.

(21) Appl. No.: 09/602,237

(22) Filed: Jun. 23, 2000

(51) Int. Cl.[7] ..... A47G 33/04

(52) U.S. Cl. ..... 428/7; 428/3; 428/8; 428/16; 428/542.2; 362/806; 362/808; D11/121; D11/125; D11/127; D11/128; D11/160; D26/25

(58) Field of Search ..... 428/7, 16, 12, 428/8, 542.2, 3; 446/373; 362/806, 808; D11/121, 125, 128, 127, 160; D26/25

(56) References Cited

U.S. PATENT DOCUMENTS

D. 371,987 * 7/1996 Chiu ..... D11/160
2,646,497 * 7/1953 Burnbaum .
4,601,924 * 7/1986 Birkes et al. ..... 428/7
5,085,075 * 2/1992 Baker ..... 73/188
5,283,088 * 2/1994 Alcorn ..... 428/16
5,336,536 * 8/1994 Oberzan ..... 428/8
5,451,436 * 9/1995 Shelleman ..... 428/8
5,584,571 * 12/1996 Chandler et al. .

* cited by examiner

*Primary Examiner*—Deborah Jones
*Assistant Examiner*—Abraham Bahta

(57) ABSTRACT

A decorative lawn ornament for providing inspirational three-dimensional ornamentation. The decorative lawn ornament includes a main body frame formed in the shape of an angel and having a plurality of elongate frame members, a plurality of main body lights, a secondary frame formed in the shape of a bird, a plurality of secondary lights coupled to the secondary frame, a wing motor interior to the secondary frame, a rod motor interior to the main body frame, a rod, and a linkage assembly.

10 Claims, 2 Drawing Sheets

DECORATIVE LAWN ORNAMENT

BACKGROUND OF THE INVENTION

1. Field of the Invention

The present invention relates to lawn ornaments and more particularly pertains to a new decorative lawn ornament for providing inspirational three-dimensional ornamentation.

2. Description of the Prior Art

The use of lawn ornaments is known in the prior art. More specifically, lawn ornaments heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,646,497; U.S. Pat. No. Des. 373,097; U.S. Pat. No. Des. 371,987; U.S. Pat. No. Des. 304,347; U.S. Pat. No. 4,601,924; and U.S. Pat. No. 5,584,571.

While these devices fulfill their respective, particular objectives and requirements, the aforementioned patents do not disclose a new decorative lawn ornament. The inventive device includes a main body frame formed in the shape of an angel and having a plurality of elongate frame members, a plurality of main body lights, a secondary frame formed in the shape of a bird, a plurality of secondary lights coupled to the secondary frame, a wing motor interior to the secondary frame, a rod motor interior to the main body frame, a rod, and a linkage assembly.

In these respects, the decorative lawn ornament according to the present invention substantially departs from the conventional concepts and designs of the prior art, and in so doing provides an apparatus primarily developed for the purpose of providing inspirational three-dimensional ornamentation

SUMMARY OF THE INVENTION

In view of the foregoing disadvantages inherent in the known types of lawn ornaments now present in the prior art, the present invention provides a new decorative lawn ornament construction wherein the same can be utilized for providing inspirational three-dimensional ornamentation.

The general purpose of the present invention, which will be described subsequently in greater detail, is to provide a new decorative lawn ornament apparatus and method which has many of the advantages of the lawn ornaments mentioned heretofore and many novel features that result in a new decorative lawn ornament which is not anticipated, rendered obvious, suggested, or even implied by any of the prior art lawn ornaments, either alone or in any combination thereof.

To attain this, the present invention generally comprises a main body frame formed in the shape of an angel and having a plurality of elongate frame members, a plurality of main body lights, a secondary frame formed in the shape of a bird, a plurality of secondary lights coupled to the secondary frame, a wing motor interior to the secondary frame, a rod motor interior to the main body frame, a rod, and a linkage assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new decorative lawn ornament apparatus and method which has many of the advantages of the lawn ornaments mentioned heretofore and many novel features that result in a new decorative lawn ornament which is not anticipated, rendered obvious, suggested, or even implied by any of the prior art lawn ornaments, either alone or in any combination thereof.

It is another object of the present invention to provide a new decorative lawn ornament, which may be easily and efficiently manufactured and marketed.

It is a further object of the present invention to provide a new decorative lawn ornament, which is of a durable and reliable construction.

An even further object of the present invention is to provide a new decorative lawn ornament which is susceptible of a low cost of manufacture with regard to both materials and labor, and which accordingly is then susceptible of low prices of sale to the consuming public, thereby making such decorative lawn ornament economically available to the buying public.

Still yet another object of the present invention is to provide a new decorative lawn ornament which provides in the apparatuses and methods of the prior art some of the advantages thereof, while simultaneously overcoming some of the disadvantages normally associated therewith.

Still another object of the present invention is to provide a new decorative lawn ornament for providing inspirational three-dimensional ornamentation.

Yet another object of the present invention is to provide a new decorative lawn ornament which includes a main body frame formed in the shape of an angel and having a plurality of elongate frame members, a plurality of main body lights, a secondary frame formed in the shape of a bird, a plurality of secondary lights coupled to the secondary frame, a wing motor interior to the secondary frame, a rod motor interior to the main body frame, a rod, and a linkage assembly.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
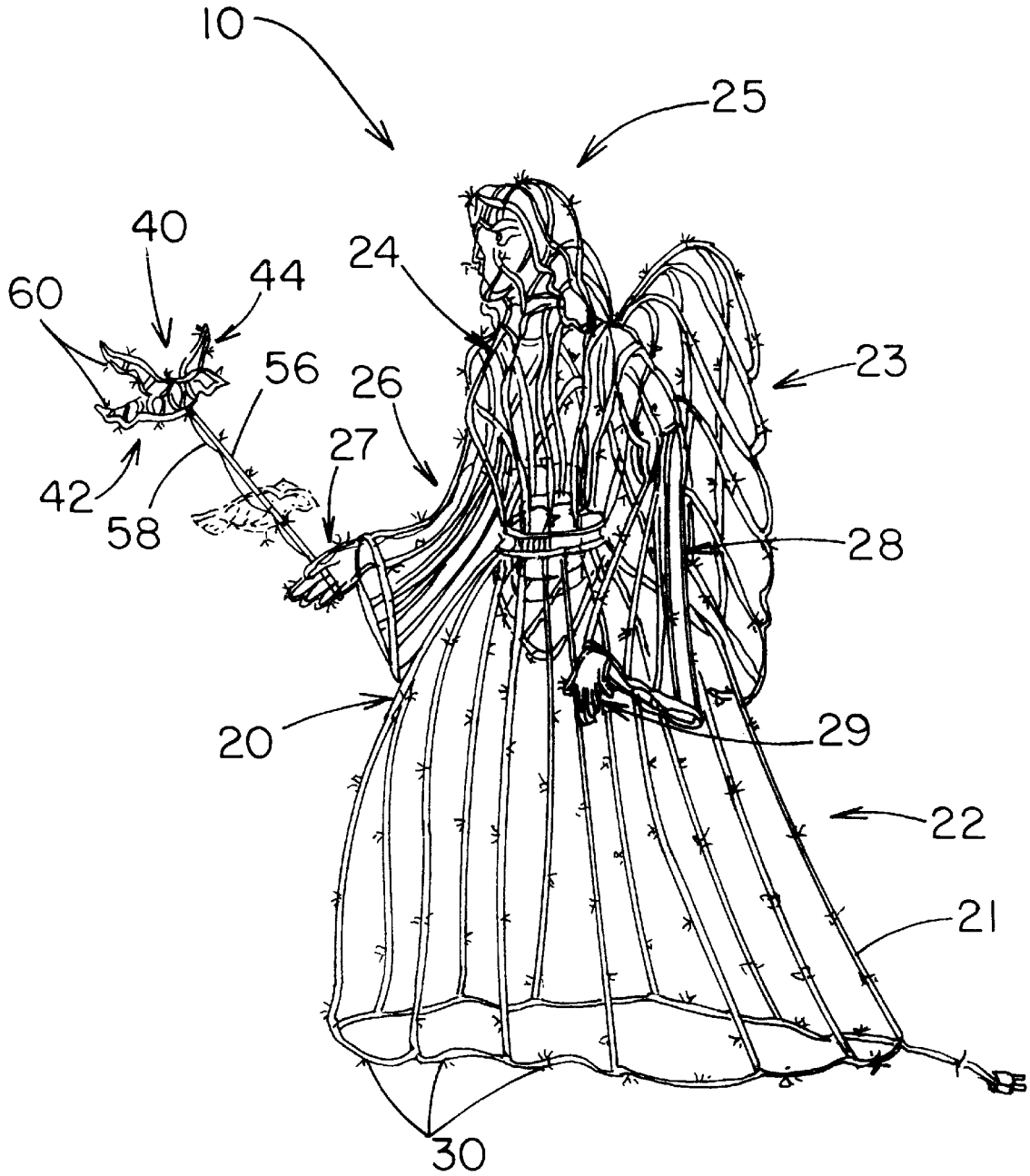
FIG. 1 is a schematic perspective view of a new decorative lawn ornament according to the present invention.
Figure 2:
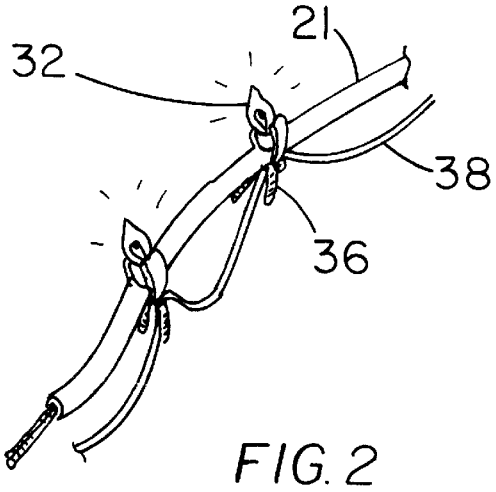
FIG. 2 is a schematic detail view of the present invention.
Figure 3:
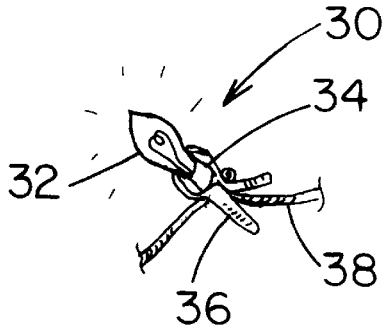
FIG. 3 is a schematic detail view of lights and a frame member of the present invention taken along line 3—3 of the present invention.
Figure 4:
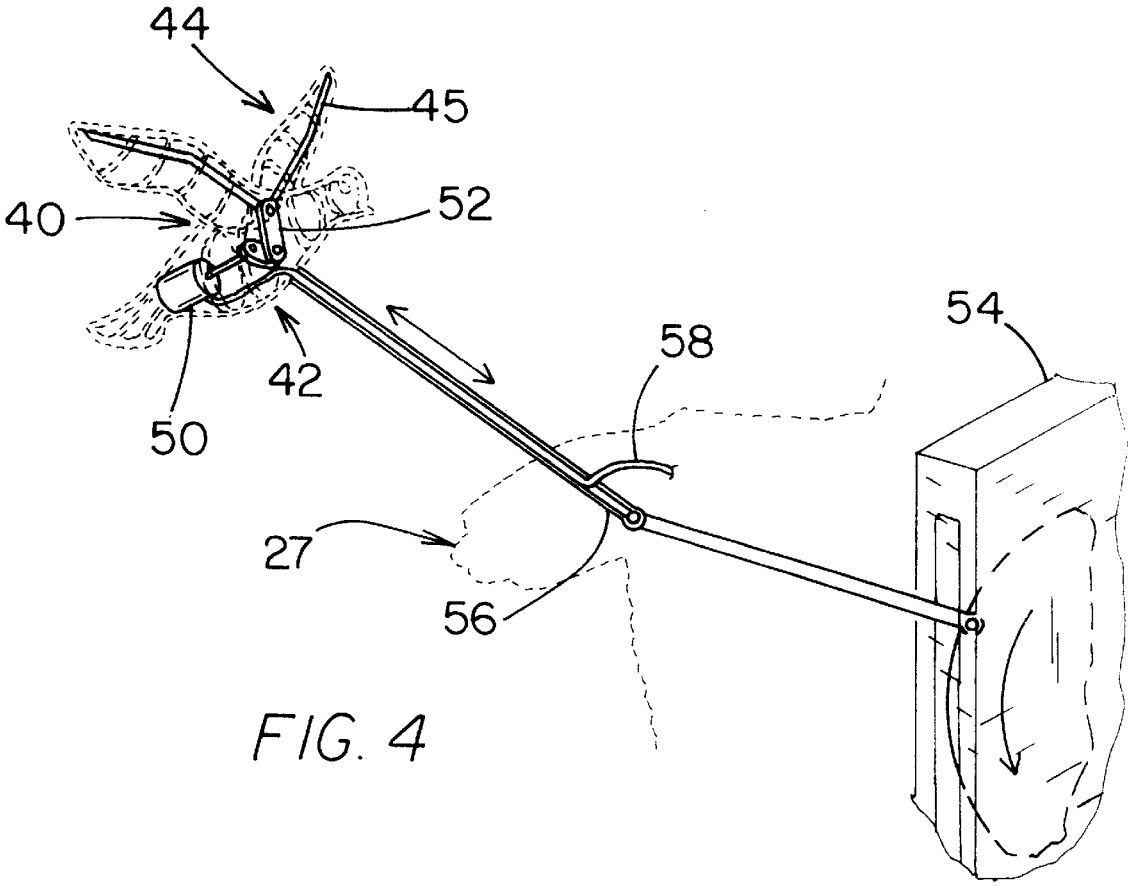
FIG. 4 is a schematic detail view of the wing and rod motors of the present invention.

With reference now to the drawings, and in particular to FIGS. 1 through 4 thereof, a new decorative lawn ornament embodying the principles and concepts of the present invention and generally designated by the reference numeral 10 will be described.

As best illustrated in FIGS. 1 through 4, the decorative lawn ornament 10 generally comprises a main body frame 20, a plurality of main body lights 30, a secondary frame 40, a plurality of secondary frame lights 60, a pair of wing arms 45, a wing motor 50, a linkage assembly 52, an extendable rod 56, and a rod motor 54.

The main body frame 20 includes a plurality of elongated frame members 21. Each of the elongated frame members 21 is a substantially malleable wire member and a plastic coating covering the wire member.

The main body frame 20 is formed in the shape of an angel. The main body frame 20 includes a skirting portion 22, a torso portion 24, an outstretched arm portion 26, an outstretched hand portion 27 positioned at a distal end of the outstretched arm portion 26, a second arm portion 28, a second hand portion 29 positioned at a distal end of the second arm portion 28 , a wings portion 23, and a head portion 25.

The plurality of main body lights 30 is coupled to the main body frame 20. Each of the main body lights 30 includes a main body bulb 32, a main body socket 34, and a main body spring clip 36 for facilitating coupling of each of the main body lights 30 to a selectable position on the main body frame 20.

The main body lights 30 are interconnected by an electrical wire 38 for providing power to each of the main body lights 30.

In an embodiment the main body lights 30 coupled to the head portion 25, the outstretched hand portion 27, the second hand portion 29, and the wings portion 23 are white.

In an embodiment the main body lights 30 coupled to the skirting portion 22, the torso portion 24, the outstretched arm portion 26, and the second arm portion 28 are blue for facilitating the skirting portion 22 the torso portion 24, the outstretched arm portion 26, and the second arm portion 28 appearing to be a robe.

The secondary frame 40 is shaped to resemble a bird. The secondary frame 40 is coupled to the outstretched hand portion 27.

In an embodiment the secondary frame 40 includes a body portion 42 and a pair of wing portions 44.

Each of the wing arms 45 extends through an associated one of the wing portions 44.

The wing motor 50 is coupled to an interior of the secondary frame 40.

The linkage assembly 52 is coupled between the wing motor 50 and the wing arms 45 such that the motor 50 pivots the wing arms 45 for flapping the wing portions 44 of the secondary frame 40.

The extendable rod 56 is coupled to the main body frame 20. The rod 56 is extendable from the outstretched hand portion 27. The rod .56 includes a hollow distal portion.

A wing motor power wire 58 extends through the hollow distal portion of the rod 56 for providing power to the wing motor 50.

The rod motor 54 is coupled to an interior of the main body frame 20 for selectively extending the rod 56.

The secondary frame 40 is coupled to a distal end of the rod 56. Thus the secondary frame 40 appears to land on the outstretched hand portion 27 when the rod 56 is retracted.

The secondary frame lights 60 are coupled to the secondary frame 40. Each of the secondary frame lights 60 includes a secondary frame bulb, a secondary frame socket, and a secondary frame spring clip for facilitating coupling of each of the secondary frame lights 60 to a selectable position on the secondary frame 40.

The secondary frame lights 60 are interconnected by an electrical wire 38 for providing power to each of the secondary frame lights 60.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A lawn ornament comprising:

a main body frame having a plurality of elongated frame members;

a plurality of main body lights coupled to said main body frame;

said main body frame forming a shape of an angel;

said main body frame having an outstretched hand portion;

a secondary frame wherein the secondary frame forms a shape of a bird, said secondary frame being coupled to said outstretched hand portion; and a plurality of secondary frame lights coupled to said secondary frame.

2. The lawn ornament of claim 1 further comprising:

each of said elongated frame members being a substantially malleable wire member and a plastic coating covering said wire member;

said main body frame having a skirting portion, a torso portion, an outstretched arm portion, an outstretched hand portion positioned at a distal end of said outstretched arm portion, a second arm portion, a second hand portion positioned at a distal end of said second arm portion, a wings portion, and a head portion.

3. The lawn ornament of claim 2, further comprising:

each of said main body lights including a main body bulb, a main body socket, and a main body spring clip for facilitating coupling of each of said main body lights to a selectable position on said main body frame;

said main body lights being interconnected by an electrical wire for providing power to each of said main body lights;

each of said secondary frame lights including a secondary frame bulb, a secondary frame socket, and a secondary frame spring clip for facilitating coupling of each of said secondary frame lights to a selectable position on said secondary frame; and said secondary frame lights being interconnected by an electrical wire for providing power to each of said secondary frame lights.

4. The lawn ornament of claim 2, further comprising:

wherein said main body lights coupled to said head portion, said outstretched hand portion, said second hand portion, and said wings portion are white;

wherein said main body lights coupled to said skirting portion, said torso portion, said outstretched arm portion, and said second arm portion are blue for facilitating said skirting portion, said torso portion, said outstretched arm portion, and said second arm portion appearing to be a robe.

5. The lawn ornament of claim 1 further comprising:

wherein said secondary frame includes a body portion and a pair of wing portions;

a pair of wing arms, each of said wing arms extending through an associated one of said wing portions;

a wing motor coupled to an interior of said secondary frame;

a linkage assembly coupled between said wing motor and said wing arms such that said motor pivots said wing arms for flapping said wing portions of said secondary frame.

6. The lawn ornament of claim 5 further comprising:

an extendable rod coupled to said main body frame, said rod being extendable from said outstretched hand portion;

said rod including a hollow distal portion;

a wing motor power wire extending through said hollow distal portion of said rod for providing power to said wing motor;

a rod motor coupled to an interior of said main body frame for selectively extending said rod;

said secondary frame being coupled to a distal end of said rod whereby said secondary frame appears to land on said outstretched hand portion when said rod is retracted.

7. The lawn ornament of claim 1 further comprising:

each of said elongated frame members being a substantially malleable wire member and a plastic coating covering said wire member;

said main body frame having a skirting portion, a torso portion, an outstretched arm portion, an outstretched hand portion positioned at a distal end of said outstretched arm portion, a second arm portion, a second hand portion positioned at a distal end of said second arm portion, a pair of wing portions, and a head portion;

wherein said secondary frame includes a body portion and a pair of wing portions;

a pair of wing arms, each of said wing arms extending through an associated one of said wing portions;

a wing motor coupled to an interior of said secondary frame;

a linkage assembly coupled between said wing motor and said wing arms such that said motor pivots said wing arms for flapping said wing portions of said secondary frame.

8. The lawn ornament of claim 7 further comprising:

each of said main body lights including a main body bulb, a main body socket, and a main body spring clip for facilitating coupling of each of said main body lights to a selectable position on said main body frame;

said main body lights being interconnected by an electrical wire for providing power to each of said main body lights;

each of said secondary frame lights including a secondary frame bulb, a secondary frame socket, and a secondary frame spring clip for facilitating coupling of each of said secondary frame lights to a selectable position on said secondary frame;

said secondary frame lights being interconnected by an electrical wire for providing power to each of said secondary frame lights;

wherein said main body lights coupled to said head portion, said outstretched hand portion, said second hand portion, and said wings portion are white;

wherein said main body lights coupled to said skirting portion, said torso portion, said outstretched arm portion, and said second arm portion are blue for facilitating said skirting portion, said torso portion, said outstretched arm portion, and said second arm portion appearing to be a robe.

9. The lawn ornament of claim 7 further comprising:

an extendable rod coupled to said main body frame, said rod being extendable from said outstretched hand portion;

said rod including a hollow distal portion;

a wing motor power wire extending through said hollow distal portion of said rod for providing power to said wing motor;

a rod motor coupled to an interior of said main body frame for selectively extending said rod;

said secondary frame being coupled to a distal end of said rod whereby said secondary frame appears to land on said outstretched hand portion when said rod is retracted.

10. A lawn ornament comprising:

a main body frame having a plurality of elongated frame members, each of said elongated frame members being a substantially malleable wire member and a plastic coating covering said wire member;

said main body frame forming a shape of an angel, said main body frame having a skirting portion, a torso portion, an outstretched arm portion, an outstretched hand portion positioned at a distal end of said outstretched arm portion, a second arm portion, a second hand portion positioned at a distal end of said second arm portion, a wings portion, and a head portion;

a plurality of main body lights coupled to said main body frame;

each of said main body lights including a main body bulb, a main body socket, and a main body spring clip for facilitating coupling of each of said main body lights to a selectable position on said main body frame;

said main body lights being interconnected by an electrical wire for providing power to each of said main body lights;

wherein said main body lights coupled to said head portion, said outstretched hand portion, said second hand portion, and said wings portion are white;

wherein said main body lights coupled to said skirting portion, said torso portion, said outstretched arm portion, and said second arm portion are blue for facilitating said skirting portion, said torso portion, said outstretched arm portion, and said second arm portion appearing to be a robe;

a secondary frame, said secondary frame being shaped to resemble a bird, said secondary frame being coupled to said outstretched hand portion;

wherein said secondary frame includes a body portion and a pair of wing portions;

a pair of wing arms, each of said wing arms extending through an associated one of said wing portions;

a wing motor coupled to an interior of said secondary frame;

a linkage assembly coupled between said wing motor and said wing arms such that said motor pivots said wing arms for flapping said wing portions of said secondary frame;

an extendable rod coupled to said main body frame, said rod being extendable from said outstretched hand portion;

said rod including a hollow distal portion;

a wing motor power wire extending through said hollow distal portion of said rod for providing power to said wing motor;

a rod motor coupled to an interior of said main body frame for selectively extending said rod;

said secondary frame being coupled to a distal end of said rod whereby said secondary frame appears to land on said outstretched hand portion when said rod is retracted;

a plurality of secondary frame lights, said secondary frame lights being coupled to said secondary frame;

each of said secondary frame lights including a secondary frame bulb, a secondary frame socket, and a secondary frame spring clip for facilitating coupling of each of said secondary frame lights to a selectable position on said secondary frame; and said secondary frame lights being interconnected by an electrical wire for providing power to each of said secondary frame lights.

* * * * *